US005372195A

United States Patent [19]

Swanson et al.

[11] Patent Number: 5,372,195

[45] Date of Patent: Dec. 13, 1994

[54] METHOD FOR DIRECTIONAL HYDRAULIC FRACTURING

[75] Inventors: David E. Swanson, West St. Paul; Daniel W. Daly, Crystal, both of Minn.

[73] Assignee: The United States of America as represented by the Secretary of the Interior, Washington, D.C.

[21] Appl. No.: 119,551

[22] Filed: Sep. 13, 1993

[51] Int. Cl.[5] ..... E21B 43/26; E21B 33/138

[52] U.S. Cl. ..... 166/308; 166/281; 299/21

[58] Field of Search ..... 166/281, 282, 308, 271, 166/259, 280, 187; 299/21

[56] References Cited

U.S. PATENT DOCUMENTS

| | | | |
|---|---|---|---|
| 3,419,070 | 12/1968 | Ernst | 166/281 X |
| 3,431,977 | 3/1969 | East et al. | 166/281 |
| 3,830,299 | 8/1974 | Thomeer | 166/281 X |
| 3,987,850 | 10/1976 | Fitch | 166/281 |
| 4,750,562 | 1/1988 | Jennings, Jr. | 166/281 |
| 5,111,881 | 5/1992 | Soliman et al. | 166/281 X |
| 5,273,115 | 12/1993 | Spafford | 166/281 |

*Primary Examiner*—Stephen J. Novosad
*Attorney, Agent, or Firm*—E. Philip Koltos

[57] ABSTRACT

A method for directional hydraulic fracturing using borehole seals to confine pressurized fluid in planar permeable regions, comprising: placing a sealant in the hole of a structure selected from geologic or cemented formations to fill the space between a permeable planar component and the geologic or cemented formation in the vicinity of the permeable planar component; making a hydraulic connection between the permeable planar component and a pump; permitting the sealant to cure and thereby provide both mechanical and hydraulic confinement to the permeable planar component; and pumping a fluid from the pump into the permeable planar component to internally pressurize the permeable planar component to initiate a fracture in the formation, the fracture being disposed in the same orientation as the permeable planar component.

14 Claims, 5 Drawing Sheets

METHOD FOR DIRECTIONAL HYDRAULIC FRACTURING

The invention described herein may be manufactured, used and licensed by or for the Government for governmental purposes without the payment to us of any royalties thereon.

FIELD OF THE INVENTION

The invention pertains to a simplified method for hydraulic fracturing from a borehole in rock and more particularly to a method for controlling the origin and orientation of hydraulic fractures generated from a borehole in a rock formation. As such, the invention may find application in the many fields where hydraulic fracturing is performed, such as oil and gas production, mining, water well stimulation, and civil engineering.

BACKGROUND OF THE INVENTION

In recent years, hydraulic fracturing applications from boreholes in geological formations have expanded dramatically to meet the needs of such emerging technologies as in situ leaching, horizontal completion of oil and gas wells, methane gas mining, and non-explosive rock demolition. Years ago, hydraulic fracturing was characterized by generation of randomly oriented fractures and mere propping or extending of existing cracks or partings. Increasingly, success of a hydraulic fracturing job is dependent upon control of hydraulic fracture origin and orientation. In some applications, hydraulic fractures must originate at a specified location along the length of a borehole. In other applications, hydraulic fractures must run with a specified orientation to the local geologic structure, the borehole from which they originate, or some other structure.

The key to directional hydraulic fracturing is to restrict pressurized fluids and their egress to the desired fracturing plane so that tensile stresses are concentrated in the desired fracturing plane and the tensile strength of the geologic formation is exceeded in only the desired fracturing plane.

The prior art of borehole sealing is adept at isolating a particular section of borehole and preventing leakage of fracturing fluids into unconfined sections of a borehole, but this prior art is poorly suited to the task of directional hydraulic fracturing. Because their sealing elements can not be closely positioned, current borehole tools employing MECHANICAL PACKERS and INFLATABLE PACKERS can not restrict pressurized fluids to a desired fracturing plane. Because boreholes dilate in response to internal pressurization, an annular gap may develop between CEMENT PLUGS and the surrounding formation during borehole pressurization activities. Methods that use a PENETRATING FLUID placed at a selected elevation in a borehole surrounded above and below by a non-penetrating fluid to restrict fluid egress from the borehole do not concentrate tensile stresses in a plane.

The prior art of directional hydraulic fracturing typically resorts to BOREHOLE ALTERATION TECHNIQUES to control the subsequent direction of hydraulic fracturing. Borehole alteration techniques are used at the borehole interface with the expectation that subsequent hydraulic fracturing will follow in the orientation prescribed by the borehole alteration. Notching and fracturing techniques are most common whereas a subsequent hydraulic fracture is intended to follow in the orientation of a notch or fracture. WATERJET NOTCHING techniques use a waterjet to cut a notch into the borehole wall. The complexity of waterjet notching is largely dependent upon the geologic formation. Hard formations require such specialized waterjet cutting practices as ultra-high-pressure water jetting or abrasive water jetting. Soft formations sometimes require that a plastic casing patch be applied to the borehole before waterjet notching to prevent excessive borehole erosion. SHAPED EXPLOSIVE CHARGE techniques use explosives bundled in a designed configuration to notch a borehole. In weak geologic formations, a borehole patch is required to restrict the effects of the explosives to only the desired orientation. MECHANICAL NOTCHING techniques commonly use an indentor to generate a notch in a borehole wall. Unfortunately, these borehole alteration techniques are complicated operations involving special skills and tools.

Furthermore, borehole properties such as diameter, length, and wall conditions can make hydraulic fracturing difficult to control and can compromise the performance of current directional fracturing techniques. Short boreholes and boreholes with small diameter may exceed the dimensional requirements of some hydraulic fracturing hardware. Rough or uneven borehole walls may exceed the working limitations of some hydraulic fracturing techniques and corresponding equipment. To enable adequate borehole pressurization, the hydraulic fracturing technique must restrict permeation of the fracturing fluid to a rate commensurate with pumping equipment and the pressure required for fracturing.

Hydraulic fracturing applications are often cost sensitive. In some applications, hydraulic fracturing is uneconomical because of equipment expense or the purchase of expensive hydraulic equipment can be justified only on the basis of equipment recovery and re-use. When an unstable rock mass does not permit equipment recovery due to borehole closure, equipment cost can compromise the suitability of current directional fracturing techniques.

SUMMARY OF THE INVENTION

One object of the present invention is to provide a method for confinement of high-pressure fluids in planar spaces in a borehole in a geologic formation.

A further object of the present invention is to provide a method that simplifies directional hydraulic fracturing procedures for geologic formations and thereby offers an improved alternative to requiring borehole preparation, borehole alteration, and borehole sealing operations.

Another object of the present invention is to provide a method for directional hydraulic fracturing of a geologic formation that is adaptable to a wide variation of borehole sizes and wall conditions.

Yet another object of the present invention is to provide a method for directional hydraulic fracturing of a geologic formation that utilizes inexpensive equipment and materials to reduce the hardship encountered when directional hydraulic fracturing equipment can not be recovered from a borehole.

A still further object of the present invention is to provide a method for directional hydraulic fracturing of a geologic formation wherein a permeable region of desired geometry may be located between a borehole, a sealant, and an injection tube.

Another object of the present invention is to provide a method for directional hydraulic fracturing of a geologic formation wherein a permeable planar region may be located between a borehole, a sealant, and an injection tube.

A yet further object of the present invention is to provide a method for directional hydraulic fracturing of a geologic formation wherein the permeable planar region is a permeable material in a planar configuration and may be located between a borehole, a sealant, and an injection tube.

Another object of the present invention is to provide a method for directional hydraulic fracturing of a geologic formation wherein the permeable planar device contains a permeable space between parallel surfaces of impermeable materials and may be located between a borehole, a sealant, and an injection tube.

Yet another object of the present invention is to provide a method for directional hydraulic fracturing of a geologic formation wherein a planar region within an inflatable device may be located between a borehole, a sealant, and an injection tube, the inflatable device being inflated to directionally initiate fractures in the surrounding formation, provide rupture along its seams, and propagate fractures generated during inflation by release of pressurized fluids into the before mentioned fractures.

Another object of the present invention is to provide a method for directional hydraulic fracturing of a geologic formation wherein a permeable planar region may be located between a borehole, an expanding chemical seal, and an injection tube.

These and other objects of the present invention are accomplished by utilizing a device that contains a planar region into which fluids may be pumped, and high-pressure tubing, and a sealant. The device that contains a planar region is located between a borehole, a sealant, and an injection tube and is positioned in the plane of the intended fracture. This injection tube is in communication with both the device that forms a permeable planar region and a pump so that a pressurized fluid such as pressurized water can be introduced into the permeable planar region for purposes of directional hydraulic fracturing.

These and other objects of the present invention will become more apparent by reference to the drawing figures and the detailed description of the invention.

BRIEF DESCRIPTION OF THE DRAWINGS

The invention is further described by way of examples with reference to the accompanying drawings in which.

DETAILED DESCRIPTION OF THE INVENTION

The present invention is a method for directional hydraulic fracturing using a sealant to confine pressurized fluids in planar permeable regions, comprising: a hole in a structure selected from geologic or cemented formations; a permeable planar component selected from devices that confine a fluid to a planar region or permeable materials having a planar configuration; a hydraulic connection between the permeable planar component and a pump; emplacement of the permeable planar component within the confines of the hole in the geologic or cemented formation; placement of a sealing component in the hole filling the space between the permeable planar component and the geologic or cemented formation in the vicinity of the permeable planar component; permitting the sealing component to cure; pumping a fluid to internally pressurize the permeable planar component with the aim of initiating a fracture in the formation, the fracture being disposed in the same orientation as the permeable planar component; and propagating the fracture by additional pumping of pressurized fluids.

The present invention employs a sealing component to restrict pressurized fluids to a planar region within a hole in a geologic or cemented formation so that in the vicinity of the hole the tensile strength of this formation is exceeded in only the desired fracturing plane and so that hydraulic fracturing may proceed thereafter. This requires that the sealant have stiffness approaching that of the formation to be fractured and be anchored to the walls of the hole in a similarly rigid manner. The planar region is created by casting a permeable planar component within the sealant. The permeable planar component receives pressurized fluid and exerts pressure predominantly along parallel and opposing surfaces that are oriented along the intended hydraulic fracturing plane. This pressurization upon parallel and opposing surfaces induces fracturing to occur in the plane separating the opposing surfaces and promotes the ensuing hydraulic propagation of these fractures.

According to the present invention, the planar region that receives pressurized fluids may be placed in a variety of positions and orientations within a hole in a geologic or cemented formation as meets the needs of a fracturing application. Additionally, a great diversity of devices may be used to create the planar region that receives pressurized fluids.

Figure 1:
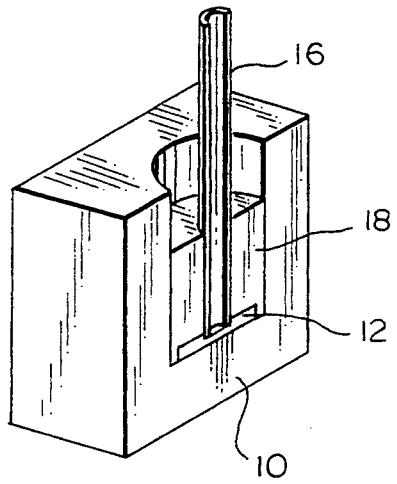
FIGS. 1 through 5 are cut-away views depicting embodiments of the invention in varied configurations with regards to the bottom of a borehole and preferred fracturing orientation.

FIG. 1 illustrates a cut-away view of a geologic or cemented formation 10 having a cylindrical hole with a flat end surface that can be made by any of several rotary drilling techniques. Into this hole and against the end surface of the hole is placed a permeable planar component 12 that is in hydraulic communication with a pump by means of a tubular component 16. A sealing component 18 is also positioned within this hole confining the permeable planar component 12 against the end of the hole and completely filling the space between the permeable planar component 12 and the formation 10 in the vicinity of the permeable planar component 12.

Figure 2:
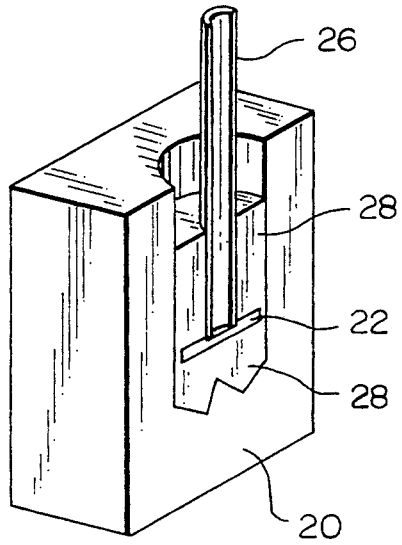

A further variation is illustrated in FIG. 2 where a permeable planar component 22 that is in hydraulic communication with a pump by means of a tubular component 26 is placed within a cylindrical hole in a geologic or cemented formation 20 at a position near the confined end of the hole. A sealing component 28 is also placed within the hole completely filling the space between the permeable planar component 22 and the formation 20 in the vicinity of the permeable planar component 22 including the space between the permeable planar component 22 and the end of this hole.

Figure 3:
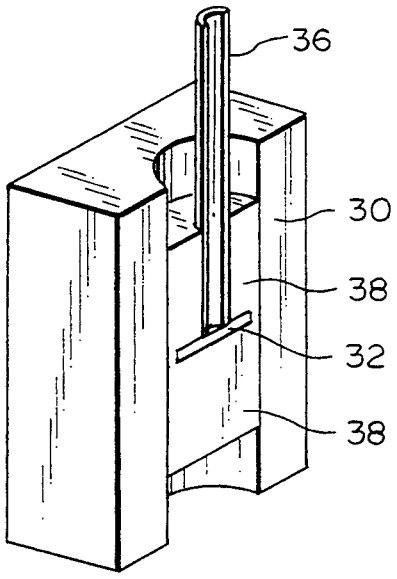

Another variation is illustrated in FIG. 3 where a permeable planar component 32 that is in hydraulic communication with a pump by means of a tubular component 36 is placed within a cylindrical hole in a geologic or cemented formation 30 at a position that is remote from the confined end of the hole. A sealing component 38 is also placed within the hole completely filling the space between the permeable planar component 32 and the formation 30 in the vicinity of the permeable planar component 32.

Figure 4:
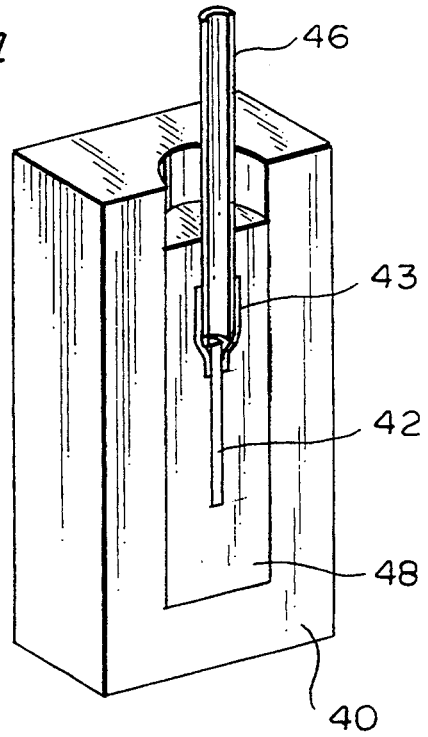

FIG. 4 illustrates a variation of the present invention that includes a geologic or cemented formation 40 having a cylindrical hole that can be made by any of several rotary drilling techniques. Into this hole is placed a permeable planar component 42 that is in hydraulic communication with a pump by means of a tubular component 46 and an impermeable connector 43 at a position near the end of the hole. A sealing component 48 is also placed within the hole completely filling the space between the permeable planar component 42 and the geologic of cemented formation 40 in the vicinity of the permeable planar component 42.

Figure 5:
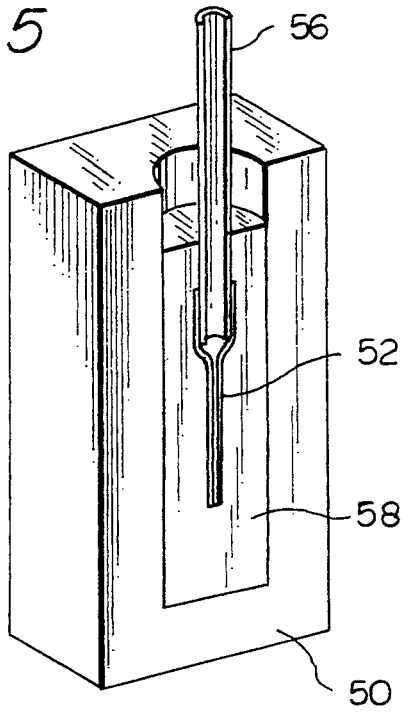

FIG. 5 illustrates a variation of the present invention that includes a geologic or cemented formation 50 having a cylindrical hole that can be made by any of several rotary drilling techniques. Into this hole is placed a permeable planar component 52 that is in hydraulic communication with a pump by means of a tubular component 56 at a position near the end of the hole. A sealing component 58 is also placed within the hole filling the space between the permeable planar component 52 and the geologic or cemented formation 50 in the vicinity of the permeable planar component 52.

The permeable planar component may be selected from a variety of devices that when used with the sealant serve to confine a fluid to a planar region. Aggregates and granular materials such as sand can be configured into a single layer for the purpose of creating a permeable planar component. Rigid materials composed of cemented solids with interconnecting pores such as sandstone and agglomerations of fused glass particles may be fashioned into planar bodies for this purpose. Overlapped sheets of impermeable material such as sheet metal or plastic film may be fashioned into suitable permeable planar components. Additionally, an inflatable device having a planar configuration prior to inflation, being impermeable prior to inflation, and being capable of rupturing as the result of excessive inflation may serve as the permeable planar component.

Figure 6:
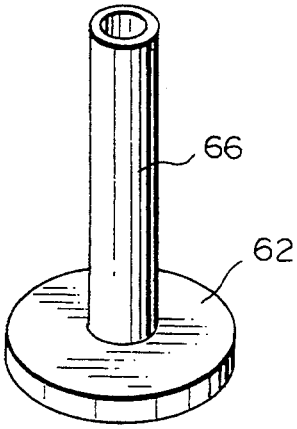
FIGS. 6 through 13 illustrate a variety of permeable planar components which receive pressurized fluids for use in the apparatus of the invention.
Figure 7:
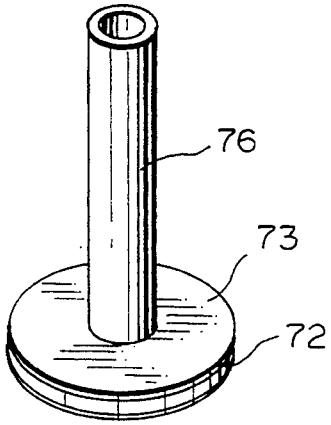
Figure 8:
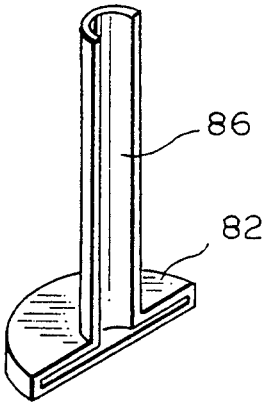

The permeable planar component may also be selected from a variety of devices that facilitate placement in the desired or preselected fracturing plane. FIGS. 6 through 8 show permeable planar components that are circular in shape and used to direct hydraulic fractures in orientations that are roughly perpendicular to the central axis of a cylindrical borehole.

FIG. 6 illustrates a permeable planar component 62 that is placed in hydraulic communication with a tubular component 66 that may be a length of metal tubing. The permeable planar component 62 is in the form of rigid permeable disk and may be made of any suitable material. For the purposes of economy and strength, a rigid permeable disk may be made by sawing disk-shaped pieces from a core specimen of a competent and permeable stone such as Berea Sandstone.

FIG. 7 illustrates a permeable planar component composed of overlapping sheets of impermeable material that is placed in hydraulic communication with a tubular component 76. The overlapping sheets of impermeable material are in the form of a thin impermeable disk 72 and thin impermeable disk with a central perforation 73. The thin impermeable disk with a central perforation 73 and tubular component 76 are connected to each other in a fashion that creates an impermeable seal that directs fluids exiting the tubular component 76 through the perforation in the thin impermeable disk with a central perforation 73 without leakage. This connection may be accomplished by such processes as soldering, welding, and gluing. The thin impermeable disk 72 and thin impermeable disk with a central perforation 73 are placed together in a manner that maximizes overlap and minimizes separation.

In a cut-away view, FIG. 8 depicts a permeable planar component composed of an inflatable device 82 having a planar configuration prior to inflation. This inflatable device is impermeable prior to inflation and is placed in hydraulic communication with a tubular component 86. The inflatable device 82 and a tubular component 86 are connected to each other in a fashion that creates an impermeable seal that directs fluids exiting the tubular component 86 into the inflatable device 82. During the inflation process, the inflatable device 82 generates fractures of preferred orientation into the surrounding material. With continued inflation, the inflatable device 82 ruptures due to over-inflation and releases fluid into the newly formed fractures whereby influx of pressurized fluid propagate the fractures of preferred orientation.

Figure 9:
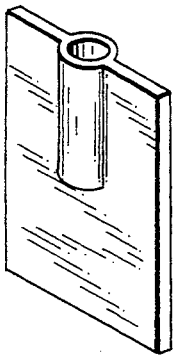
Figure 10:
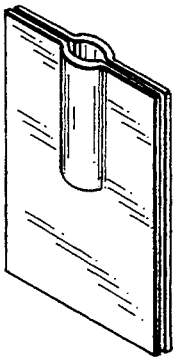
Figure 11:
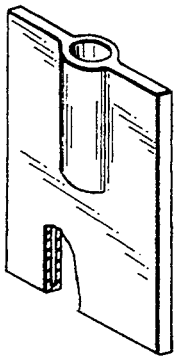
Figure 12:
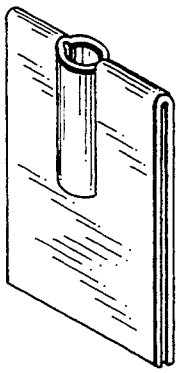
Figure 13:
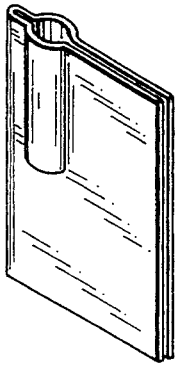

FIGS. 9 through 13 represent permeable planar components that are rectangular in shape and could be used to direct hydraulic fractures in orientations that are roughly parallel to the central axis of a cylindrical borehole. FIG. 9 depicts a permeable solid. FIG. 10 depicts two sheets of impermeable material between which one end of a tubular component may reside. FIG. 11 depicts an inflatable device having a form that is initially planar. FIG. 12 depicts a perforated sheet whose perforation may accommodate one end of a tubular component and may be folded across the perforation in order to confine that end of the tubular component between impermeable surfaces. FIG. 13 depicts a sheet of impermeable material folded in a manner to accommodate one end of a tubular component and confine that end of a tubular component between impermeable surfaces.

Selected regions along the perimeter of the overlapped sheets of impermeable material may be sealed by such means as welding or gluing to further restrict the escape of fluids from between the overlapped sheets. In particular, sealing the overlapped perimeter in the vicinity of folds and tubular components may overcome unwanted channeling of fluids between the impermeable sheets. Additionally, if selected regions along the perimeter of the overlapped sheets of impermeable material are sealed by such means that prevent separation of the overlapping sheets at the perimeter, the generation of fracturing may be induced to occur preferentially along the unsealed perimeter.

A wide variety of sealants may be suitable for use in this invention including, but not limited, to Portland cements, hydraulic cements, high-strength early-curing cements, epoxies, and expanding chemical formulations that are modified in a particular manner. Low permeability, high-strength, and fast curing are important qualities of sealants used in this application. Additionally, ease of placement is important.

Among the preferred sealants for use in this invention are modified formulations of expanding chemical demolition agents of the sort that are commercially available under trade names such as "Betonamit®," "Bristar®," and "S-Mite®" and are sometimes referred to by the term "non-explosive demolition agent." After mixing with water, these agents are typically placed into a hole bored in a rock formation and left to cure, where during the curing process, the mixture sets and simultaneously expands exerting pressures on the walls of the hole thereby causing the rock to crack. By adding an excessive amount of water or compressible materials to the mixture, the ultimate expansive pressures generated by a mixture of expanding chemical demolition agent such as those indicated above and water may be controllably reduced to a desirable maximum level. In the context of the present invention and when emplaced with the other components of the invention into a hole in the formation to be hydraulically fractured, this desirable maximum level of pressure generated by the expanding chemical mixture is an extent that is sufficient to firmly anchor the mixture within the hole, is sufficient to enable the mixture to seal the intended region, and is sufficient to enable transformation of the mixture into a hardened mass of stiffness approaching that of the surrounding formation, yet is insufficient to generate fractures in the surrounding formation by itself.

"Betonamit®" brand expanding chemical demolition agents are sold in the United States by Betonamit of North America, Inc., of Baton Rouge, La. Shipping labels on this product line read dehydrated limestone. "Betonamit® type S" forms a putty-like kneadable mass after mixing with water. Unlike other expanding chemical demolition agents that are considerably more fluid after mixing with water, "Betonamit® type S" is amenable to being tamped into boreholes and holding its position without assistance in overhead boreholes. Having a putty-like consistency greatly reduces gravitation induced segregation of mixed constituents and thereby enables greater control of maximum pressure generation by means of dilution.

Figure 16:
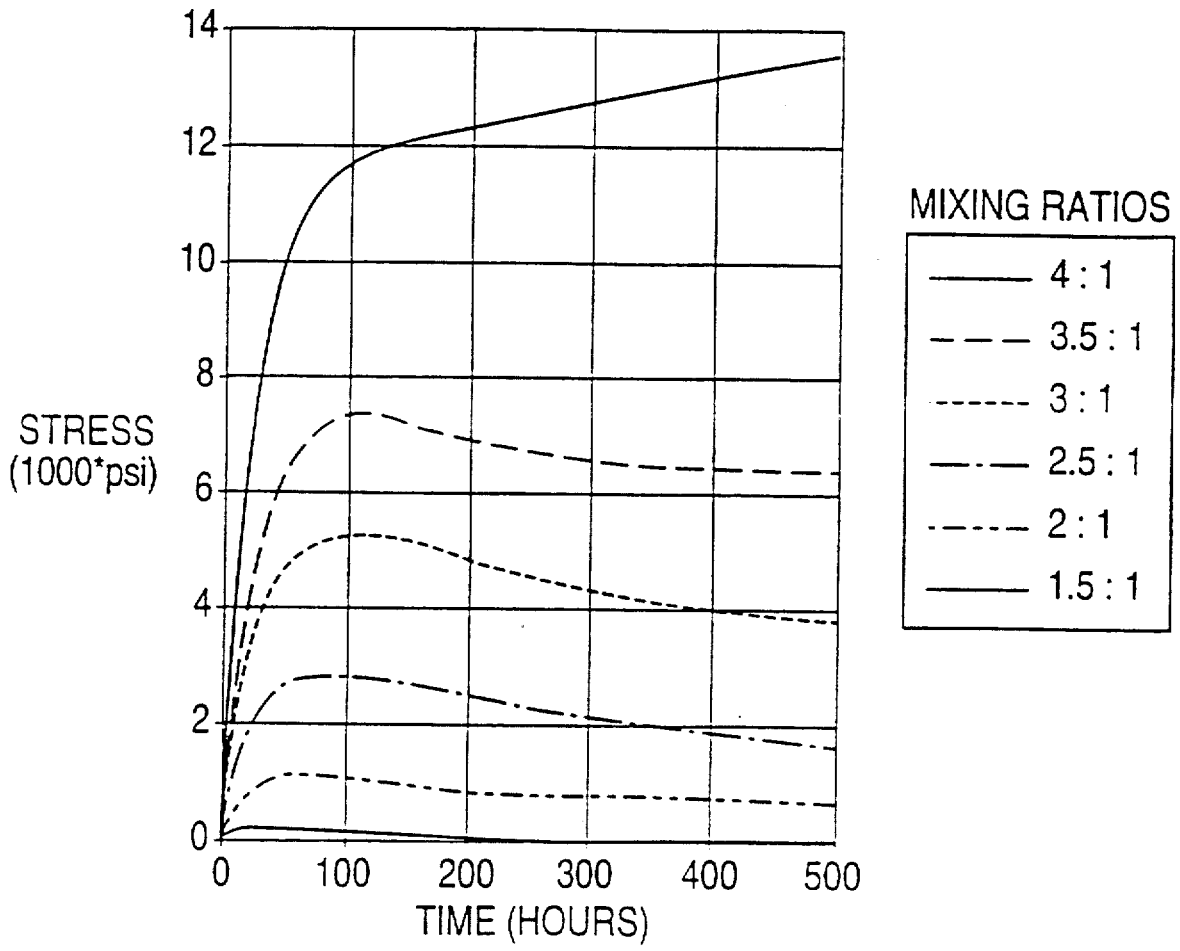

If used in this invention, it is critical that an expanding chemical mixture used for sealing does not generate pressures that directly result in fracturing of the surrounding formation. Laboratory testing by the inventors has produced a rough guide for dilution of expanding chemical formulations for use as borehole seals. Expanding chemical seals should be diluted with water so that the maximum pressure generated during the working life of the seal does not exceed the tensile strength of the surrounding formation. The following graph in FIG. 16 illustrates stress-time evolutions of various mixtures of "Betonamit® type S" and water on a weight-to-weight basis.

When used in conjunction with an expanding chemical sealant, the permeable planar component is compressed between the expanding chemical and the walls of the hole within which it is emplaced. The hydraulic connection between the permeable planar component and a pump may include such devices as high pressure tubing so that the section of this hydraulic connection that passes through an expanding chemical sealant resists collapse. The expanding chemical sealant may also serve to initially seal around the permeable planar component in order to maintain pressure within the permeable planar component prior to fracturing.

Another embodiment of the invention is the use of a cement like sealant to fill the hole in the geologic or cemented formation in the vicinity of the permeable planar component, but additionally surrounding the cement-like sealant with a quantity of expanding chemical formulation. This additional step may eliminate plastic deformation by an expanding chemical sealant in the vicinity of the permeable planar component while maintaining the resistance to seal slippage capacity of expanding chemical seal. Experiments have shown that expanding chemical seals may have a greatly increased capacity to resist slipping in a cylindrical borehole. However, expanding chemical seals may also have an increased tendency to behaving plastically and materials that behave plastically do a poor job of transferring stresses in a preferred direction.

Placement of components in a hole in a formation to be hydraulically fractured should be accomplished by means that are economical and expedient. In down-angled boreholes, sealants may be poured into the hole and around already positioned permeable planar components and their means of hydraulic communication with a pump. In horizontal and ascending boreholes, sealants with putty-like consistencies may be formed around permeable planar components and tamped into place.

The diversity of these embodiments is due in part to variations in the geometry and scale of the hole in the formation from which the fracturing is to be conducted, variations in the physical properties of the formation to be fractured, and variations in the desired orientation of fractures relative to the geometry of the hole in the formation. For cylindrical boreholes, FIGS. 1 through 3 depict embodiments that lend themselves to hydraulic fracturing in orientations that are nearly perpendicular to the borehole axis and FIGS. 4 and 5 depict embodiments for directing hydraulic fractures in a plane that is nearly parallel to the borehole axis. FIGS. 1 through 3 also illustrate the variety of configurations relative to a borehole bottom in which the invention may be embodied.

The present invention is accomplished by creating a permeable region having a planar geometry and preferred orientation within a sealant in a borehole to provide directional hydraulic fracturing when fluids are injected into the permeable region, and by the use of sealants such as high-strength fast-curing cements and specially modified hydrating expanding chemicals to seal and confine a planar region within a borehole in order to direct subsequent hydraulic fracturing.

Specifically, a hydraulic fracture that propagates from a hole in a geologic or cemented formation in a controlled direction is obtained according to the following examples:

EXAMPLE 1

Figure 14:
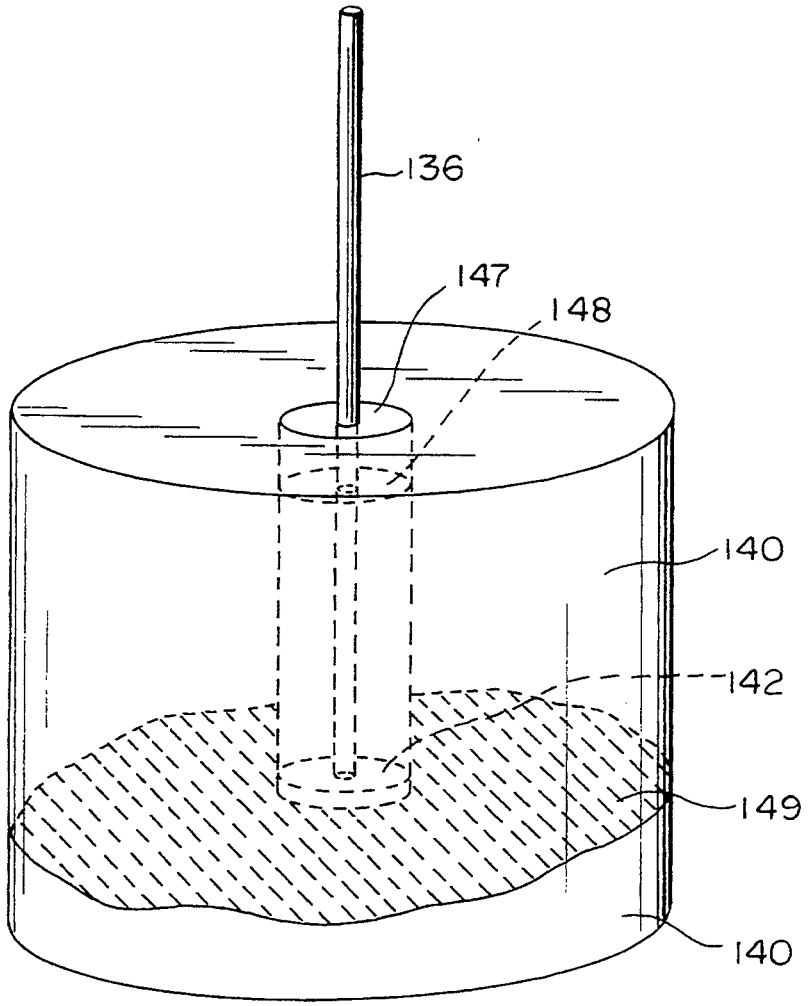
FIGS. 14 and 15 depict cylindrical formations that are made to fracture along preferred orientations as a consequence of pumping pressurized water into permeable planar components which are surrounded by a sealant in a borehole.

FIG. 14 illustrates a cylindrical cemented formation 140 that is made to hydraulically fracture along a preferred orientation as a consequence of pumping pressurized water into the permeable planar region occupied by a Berea Sandstone disk 142.

A cement cylinder is fashioned for the purpose of evaluating subsequent fracturing behavior by casting cement in a cylindrical mold to create a cemented formation 140 that is 14 inches in diameter and 11 inches long. A 6 inch long cylindrical borehole 147 having $1\frac{1}{2}$ inches internal diameter with vertical side walls and a horizontal bottom surface is created by inserting a wooden dowel into the cement after the cement is poured into the mold and removing the dowel after the cement has stiffened. The borehole 147 is located along the central axis of the cemented formation. The cement formation 140 is free from large-scale fractures. After curing for 28 days, the cement formation 140 is believed to have a tensile strength of approximately 1400 psi.

A disk-shaped permeable specimen of Berea Sandstone 142 having a diameter of $1\frac{1}{4}$ inches and a thickness of about $\frac{1}{8}$ inches is made by sawing a core sample having $1\frac{1}{4}$ inch diameter with a diamond wheel saw. This disk-shaped permeable specimen of Berea Sandstone 142 is placed at the bottom of the before mentioned borehole 147.

A certain formulation of expanding chemical sealant 148 is selected for the purposes of directional hydraulic fracturing. A formulation of "Betonamit ® type S" and water with a 2-to-1 mixing ratio on a weight-to-weight basis is selected to be insufficient in maximum expansive stress generation to directly fracture the surrounding formation 140, to provide mechanical and hydraulic resistance to the pressurized fluid entering the Berea Sandstone disk 142, and to facilitate hydraulic fracturing at a time about 48 hours after preparation of this expanding chemical sealant 148. In a plastic bag, 200 grams of "Betonamit ® type S" are mixed with 100 grams of water by manually kneading these constituents together until they form a well-blended putty-like mass.

A portion of the mixed expanding chemical sealant 148 having a putty-like consistency is formed into a shape that fits into the borehole and is tamped into and against the Berea Sandstone disk 142 residing at the bottom of the borehole 147. This portioning and tamping procedure is repeated until a 6 inch long column of expanding chemical sealant 148 confines the Berea Sandstone disk 142 against the bottom of the borehole 147.

Hydraulic communication is made between the Berea Sandstone disk 142 and the exterior of the cement formation 140 with a section of $\frac{1}{8}$ inch outside diameter steel tubing 146 that is longer than the borehole 147 is deep. This tubing 146 is pushed down the borehole 148 and through the expanding chemical sealant 148 until one end of the tubing 146 is in contact with the Berea Sandstone disk 142. To avoid possible plugging of the tubing 146 by the sealant 148, a small amount of easily extruded material such as soap, wax, or paper is pressed into the leading end of the tubing 146 prior to its insertion into the sealant 148.

Thereafter, a period of about 48 hours is permitted to elapse to enable the expanding chemical sealant 148 to cure to sufficient strength, where upon the hydraulic connections between the Berea Sandstone disk 142 and a high-pressure pump are completed.

Water is then pumped into the permeable region occupied by the Berea Sandstone disk 142 with gradually increasing pressure until a hydraulic fracture 149 is indicated by a change in pumping conditions such as a sudden increase in pumping rate for a pump delivering a constant pressure.

EXAMPLE 2

Same as Example 1, except that the step commencing with emplacing the Berea Sandstone disk 142 against the bottom of the borehole 147 through the step of tamping the expanding chemical sealant 148 against the Berea Sandstone disk 142 residing at the bottom of the borehole 147 are integrated into an improved emplacement technique by filling a length of polyvinyl chloride (PVC) tubing with the Berea Sandstone disk 142 followed by expanding chemical putty 148 and extruding these from the PVC tubing against the bottom of the borehole 147 with a plunger as the PVC tubing is withdrawn from the borehole 147.

EXAMPLE 3

Same as Example 1, except that a geologic material is used in place of the cemented material 140.

EXAMPLE 4

Same as Example 1, except that a thin layer of granular material such as sand is used in place of the Berea Sandstone disk 142.

EXAMPLE 5

Same as Example 1, except that a pair of stainless steel 20-gauge sheet metal disks as illustrated in FIG. 7 are used in place of a Berea Sandstone disk 142, one of the sheet metal disks has a hole into which the tubing is fusion welded (i.e., connected by T.I.G. welding without the use of a filler rod), and the disks are placed together into the hole prior to emplacement of expanding chemical putty 148. After the expanding chemical seal 148 is cured to sufficient strength, water is pumped through the tubing 146 and between the two sheet metal disks.

EXAMPLE 6

Same as Example 1, except that an inflatable flat jack as illustrated in FIG. 8 is used in place of a Berea Sandstone disk 142 and a high-strength fast-curing cement (CTS Rapid Set Grout mixed according to package instructions) is used in place of an expanding chemical sealant 148.

EXAMPLE 7

Same as Example 1, except that a the Berea Sandstone disk 142 is emplaced against and earlier emplacement of sealant 148 (in the hole 147) instead of against the bottom of the hole 147.

EXAMPLE 8

Figure 15:
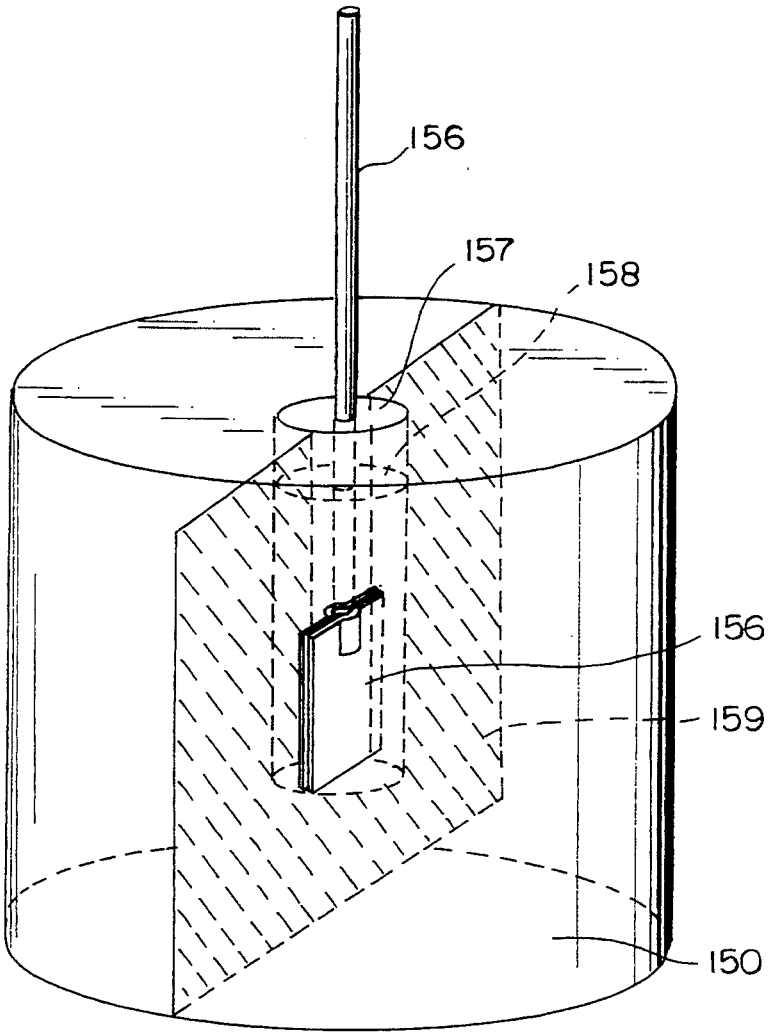

FIG. 15 illustrates a cylindrical cemented formation 150 that is made to hydraulically fracture along a preferred orientation that is roughly parallel to the axis of the tubing 156 as a consequence of pumping pressurized water into the permeable planar region residing between overlapping surfaces of sheet metal.

As in Example 1, a cement cylinder is fashioned for the purpose of evaluating subsequent fracturing behavior by casting cement in a cylindrical mold to create a cemented formation 150 that is 14 inches in diameter and 11 inches long. A 6 inch long cylindrical borehole 157 having $1\frac{1}{2}$ inches internal diameter with vertical side walls and a horizontal bottom surface is created by inserting a wooden dowel into the cement after the cement is poured into the mold and removing the dowel after the cement has stiffened. The borehole 157 is located along the central axis of the cemented formation. The cement formation 150 is free from large-scale fractures. After curing for 28 days, the cement formation 150 is believed to have a tensile strength of approximately 1400 psi.

A permeable planar component 152 of the form illustrated in FIG. 10 is fabricated from 20-gauge sheet metal by first cutting two $1\frac{1}{4}$ inch×4 inch rectangular shapes and then secondly forming the rectangular sheet metal pieces around a $\frac{1}{8}$ inch rod.

A formulation of "Betonamit® type S" and water with a 2-to-1 mixing ratio on a weight-to-weight basis is selected for the purposes of directional hydraulic fracturing. This formulation is selected to be insufficient in maximum expansive stress generation to directly fracture the surrounding formation 150, to provide mechanical and hydraulic resistance to the pressurized fluid entering the permeable planar component 152, and to facilitate hydraulic fracturing at a time about 48 hours after preparation of this expanding chemical sealant 158. In a plastic bag, 200 grams of "Betonamit® type S" are mixed with 100 grams of water by manually kneading these constituents together until they form a well-blended putty-like mass.

A portion of the mixed expanding chemical sealant 158 having a putty-like consistency is formed into a shape that fits into the borehole and is tamped into and against the bottom of the borehole 157. This portioning and tamping procedure is repeated until a 6 inch long column of expanding chemical sealant 158 resides above the bottom of the borehole 157.

This permeable planar component 152 is joined using fusion welding to the end of a section of steel tubing 156 that is $\frac{1}{8}$ inch outside diameter and is longer than the borehole 157 is deep. With the permeable planar component 152 leading the tubing 156, the permeable planar component 152 and attached tubing 156 are pushed down the borehole 157 and through the expanding chemical sealant 158 until the leading end of the permeable planar component 152 is in contact with the bottom of the borehole 157. To prevent the sealant 158 from entering the permeable planar region within the permeable planar component 152 during placement against the bottom of the borehole 157, a strip of adhesive tape is placed along the perimeter of the permeable planar component 152 prior to its insertion into the sealant 158.

Thereafter, a period of about 48 hours is permitted to elapse to enable the expanding chemical sealant 158 to cure to sufficient strength, where upon the hydraulic connections are completed between the permeable planar component 152 and a high-pressure pump.

Water is then pumped into the permeable planar region occupied by the permeable planar component 152 with gradually increasing pressure until a hydraulic fracture 159 is indicated by a change in pumping conditions such as a sudden increase in pumping rate for a pump delivering a constant pressure.

EXAMPLE 9

Same as Example 8, except that a high-strength fast-curing cement (CTS Rapid Set Grout mixed according to package instructions) is used in place of an expanding chemical sealant 158.

EXAMPLE 10

Same as Example 8, except that an inflatable device of the kind shown in FIG. 11 is used as the permeable planar component 158 in place of the kind shown in FIG. 10.

In the context of the invention, it will be appreciated that directional hydraulic fracturing using borehole seals results from the use of confined pressurized fluids within planar regions residing between parallel impermeable surfaces. Therefore, while water is the preferred and most inexpensive of fluids that may be subject to pressurization according to the process of the invention, it is by no means the only fluid that is useful. Similarly, in some embodiments of the invention, disk-shaped permeable specimens of naturally occurring Berea Sandstone may be used; however, other naturally occurring or non-naturally occurring materials that are permeable may be used in order to create permeable planar regions in a manner such that the direction of hydraulic fracturing may be controlled according to the process of the invention.

The invention has been described with reference to the preferred embodiments; however, as variations thereon will become apparent to those skilled in the art, the invention is not to be considered as limited thereto.

What is claimed is:

1. A method for directional hydraulic fracturing using a sealant within a hole in a geologic or cemented formation to confine a planar permeable region, comprising:

emplacing a planar or disk-shaped fluid permeable material in a hole in a geologic or cemented formation in a preselected orientation, to render said formation responsive to hydraulic fracturing;

placing a sealant in said hole to completely fill a space between said permeable planar material and said geologic or cemented formation in a vicinity of the permeable planar material to form a barrier to fluid migration and a barrier to physical movement, said barrier surrounding the said planar permeable material;

making a hydraulic connection between said planar permeable material and an exterior portion of said hole by pushing tubing into said hole and through said sealant until said tubing is in contact with said planar permeable material;

permitting said sealant to cure into a hardened and stiffened mass; and pumping a fluid through said tubing under gradually increasing pressure to provide a fracture in said geologic or cemented formation in a manner such that said fracture is disposed in the same orientation as the orientation of the region occupied by the planar permeable material.

2. The process of claim 1, wherein said planar or disk-shaped fluid permeable material is a layer of granular material or fine grained sand.

3. The process of claim 1, wherein said planar or disk-shaped fluid permeable material is a disk-shaped sample of a permeable geologic formation of Berea Sandstone.

4. A method for directional hydraulic fracturing using a sealant within a hole in a geologic or cemented formation to confine a planar region residing between parallel impermeable surfaces, comprising:

overlapping sheets of impermeable material to create a planar region between parallel impermeable surfaces;

making a hydraulic connection between overlapping sheets of impermeable material and tubing by welding, gluing, or compression so that pressurized fluids are constrained to pass from the tubing into the planar region between said overlapping impermeable surfaces without diversion, said tubing being capable of conveying a pressurized fluid;

emplacing said overlapping sheets of impermeable material and hydraulically connected tubing in a hole in a geologic or cemented formation in a preselected orientation with respect to said planar region between parallel surfaces and said formation, said formation being responsive to hydraulic fracturing;

placing a sealant in said hole to fill a space between said overlapping sheets of impermeable material and said geologic or cemented formation in a vicinity of said overlapping sheets of impermeable material to form a barrier to fluid migration and a barrier to physical movement, said barrier surrounding said overlapping sheets of impermeable material;

permitting said sealant to cure into a hardened and stiffened mass; and pumping a fluid through said tubing under gradually increasing pressure to provide a fracture in said geologic or cemented formation, said fracture being disposed in the same orientation as the orientation of the planar region between said overlapping sheets of impermeable material.

5. The process of claim 4, wherein said planar region residing between parallel impermeable surfaces is constructed by overlapping of sheet metal.

6. A method for directional hydraulic fracturing using a sealant within a hole in a geologic or cemented formation to confine an inflatable device which is initially planar in configuration, comprising:

fabricating an inflatable device which is initially planar in configuration and amenable to inflation through pressurization of fluids within said inflatable device;

making a hydraulic connection between said inflatable device and tubing by welding, gluing, or compression so that pressurized fluids are constrained to pass from the tubing into the inflatable device without diversion, said tubing being capable of conveying a pressurized fluid;

emplacing said inflatable device and hydraulically connected tubing in a hole in a geologic or cemented formation, said emplacement being in a preselected orientation with respect to said inflatable device and said formation, said formation being responsive to hydraulic fracturing;

placing a sealant in said hole to fill a space between said inflatable device and said geologic or cemented formation in a vicinity of said inflatable device to form a barrier to fluid migration and a barrier to physical movement, said barrier surrounding said overlapping sheets of impermeable material;

permitting said sealant to cure into a hardened and stiffened mass;

pumping a fluid under gradually increasing pressure through said tubing to inflate said inflatable device, said inflation causing pressure to be applied against surrounding structures and generating fractures of preselected orientation into said geologic or cemented formation;

pumping a fluid under gradually increasing pressure through said tubing and into said inflatable device until said inflatable device ruptures from over inflation;

pumping a fluid under gradually increasing pressure through said tubing and through the rupture in said inflatable device to fill a space of fractures in said geologic or cemented formation having preselected orientation as a consequence to inflation of said inflatable device; and pumping a fluid under gradually increasing pressure through said tubing and through said rupture in said inflatable device and into a space of fractures having preferred orientation as a consequence to inflation of said inflatable device, whereby continued influx of pressurized fluids propagates said fractures of preselected orientation within said geologic or cemented formation, said fractures being disposed in the same orientation as the orientation of the said inflatable device having planar configuration prior to inflation.

7. The process of claims 1 or 4 or 6, wherein said hole in a geologic or cemented formation is a cylindrical borehole formed by a rotary drill.

8. The process of claims 1 or 4 or 6, wherein said sealant is a high-strength and fast curing cement.

9. The process of claims 1 or 4 or 6, wherein said sealant is a formulation of an expanding chemical agent and water, said formulation having water in amounts adequate to provide sufficient expansive stress to fracture said geologic or cemented formation.

10. The process of claims 1 or 4 or 6, wherein said planar region or device that embodies said planar region is positioned within a hole in said geologic or cemented formation and against said geologic or cemented formation.

11. The process of claims 1 or 4 or 6, wherein said planar region or device that embodies the said planar region is emplaced against a seal or barrier that resides within said hole in said geologic or cemented formation.

12. The process of claims 1 or 4 or 6, wherein said planar region or device that embodies said planar region and said sealant are emplaced concurrently into said hole by extrusion from a length of tubing into which both said planar region or device that embodies the planar region and said sealant were packed.

13. The process of claims 1 or 4 or 6, wherein said planar region or device that embodies the said planar region is sized and shaped to approximate a cross-sectional area of said hole in a geologic or cemented formation at a preferred location and in said preselected orientation, said preferred location and preselected orientation being that of an intended hydraulic fracture.

14. The process of claims 1 or 4 or 6, wherein said sealant is comprised of more than one sealant, wherein said sealant is comprised of more than one sealant, these sealants having differing physical properties with regard to plastic deformation as a response to applied stresses, and these sealants being arranged in relative positions with respect to said permeable planar component and the formation to be fractured so that the sealant with greatest resistance to plastic deformation is positioned closest to the permeable planar component.

* * * * *

UNITED STATES PATENT AND TRADEMARK OFFICE

CERTIFICATE OF CORRECTION

PATENT NO. : 5,372,195

DATED : December 13, 1994

INVENTOR(S) : David E. Swanson & Daniel Daly

It is certified that error appears in the above-indentified patent and that said Letters Patent is hereby corrected as shown below:

Column 3, after line 68, insert:

Fig. 16 is a graph illustrating stress-time evolutions of various mixtures of " Betonamit® type S" and water on a weight - to - weight basis.

Column 7, lines 56 through 59, cancel the expression, " The following graph in FIG. 16 illustrates stress-time evolutions of various mixtures of " Betonamit® type S" and water on a weight - to - weight basis."

Add FIG. 16, as sheet 6 of 6.

Signed and Sealed this

Twenty-eighth Day of November 1995

*Attest:*

Bruce Lehman

BRUCE LEHMAN

*Attesting Officer*

*Commissioner of Patents and Trademarks*